United States Patent [19]

Partsch

[11] 4,056,947

[45] Nov. 8, 1977

[54] ABSORPTION REFRIGERATOR

[76] Inventor: Ernest W. Partsch, Dolderstrasse 63, Zurich, Switzerland, 8032

[21] Appl. No.: 673,744

[22] Filed: Apr. 5, 1976

[30] Foreign Application Priority Data

Apr. 15, 1975 Switzerland ..... 4806/75

[51] Int. Cl.[2] ..... F25B 15/00; F24H 3/02

[52] U.S. Cl. ..... 62/148; 62/476; 62/485; 126/110 R

[58] Field of Search ..... 62/148, 476, 485; 126/110 R; 431/80

[56] References Cited

U.S. PATENT DOCUMENTS

| | | | |
|---|---|---|---|
| 2,119,494 | 5/1938 | Smith | 62/485 |
| 2,315,356 | 3/1943 | Siedle | 62/148 |
| 2,374,185 | 4/1945 | Kleen | 62/485 |
| 3,759,244 | 9/1973 | Konet | 126/110 R |

*Primary Examiner*—Lloyd L. King
*Attorney, Agent, or Firm*—Herbert L. Lerner

[57] ABSTRACT

In an absorption refrigerator having a non-electric boiler heating system, a box having a coolable interior and a side at which refrigerating equipment is mounted, the refrigerating equipment including a boiler and a heating burner located adjacent the boiler for heating the same, electrically energizable blower means carried by the box, and thermocouple means mounted within heating range of the heating burner, the thermocouple means being electrically connected to the blower means for energizing the latter with electricity generated in the thermocouple means by the heating burner.

11 Claims, 7 Drawing Figures

ABSORPTION REFRIGERATOR

The invention relates to an absorption refrigerator and, more particularly, to such a refrigerator having a non-electric boiler heating system. Known refrigerators of this general type are operated with energy obtained from fossil fuel and are mainly used in areas not supplied by electric power. The air required for cooling such refrigerators moves very slowly by natural convection along the outside of the unit, which limits the cooling power of the refrigerators. To increase the cooling capacity, it would be desirable, therefore, to produce increased air circulation by means of a blower. This has not been possible heretofore, however, in the absence of an electric power supply system. It is, accordingly, an object of the invention to provide an absorption refrigerator which corrects this shortcoming.

With the foregoing and other objects in view, there is provided, in accordance with the invention, in an absorption refrigerator having a non-electric boiler heating system, a box having a coolable interior and a side at which refrigerating equipment is mounted, the refrigerating equipment including a boiler and a heating burner located adjacent the boiler for heating the same, electrically energizable blower means carried by the box, and thermocouple means mounted within heating range of the heating burner, the thermocouple means being electrically connected to the blower means for energizing the latter with electricity generated in the thermocouple means by the heating burner.

In accordance with other alternative features of the invention, the blower means comprise at least one blower located at the equipment side or in the coolable interior of the box or a plurality of blowers located both in the interior of the box and at the equipment side thereof.

In accordance with another feature of the invention, the refrigerating equipment includes an absorber device and at least one condenser device, the blower means being disposed beneath at least one of the devices at the equipment side, and including an equipment cover plate at the equipment side defining with the side a channel for air mechanically movable by the blower means.

In accordance with an additional feature of the invention, the absorption refrigerator includes at least one centrally apertured ceramic disc formed with radial bores and disposed relative to the heating burner so as to be heatable in the central aperture thereof, the thermocouple means comprising a multiplicity of serially-connected thermocouple elements having hot junctions located within the central aperture of the ceramic disc and cold junctions located outside the ceramic disc, and means extending through the radial bores for mutually connecting the hot and the cold junctions.

In accordance with an added feature of the invention, the multiplicity of serially connected thermocouple elements has a common tap for electric current connectible to the blower means.

In accordance with other alternate features of the invention, the ceramic disc is disposed between the heating burner and the boiler or located in the thermal insulation of the boiler or mounted above the boiler.

In accordance with yet another feature of the invention, the box has an inner casing and an outer casing, and a heater wire is included electrically connected to the thermocouple means and so disposed relative to the outer casing of the box to prevent condensation formation thereat.

In accordance with a concomitant feature of the invention, the absorption refrigerator includes signaling means connected to the heating burner, the signaling means being responsive to an interruption in electrical energy supplied by the thermocouple means.

Other features which are considered as characteristic for the invention are set forth in the appended claims.

Although the invention is illustrated and described herein as embodied in an absorption refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 5 is a fragmentary enlarged longitudinal sectional view of

Figure 4:
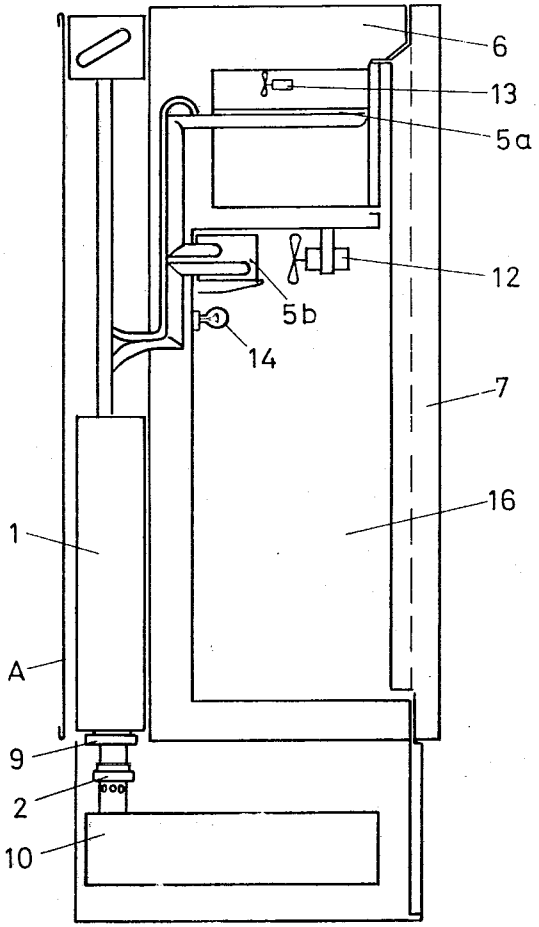
FIG. 4 is a side elevational view, partly in section, of FIG. 3.
Figure 6:
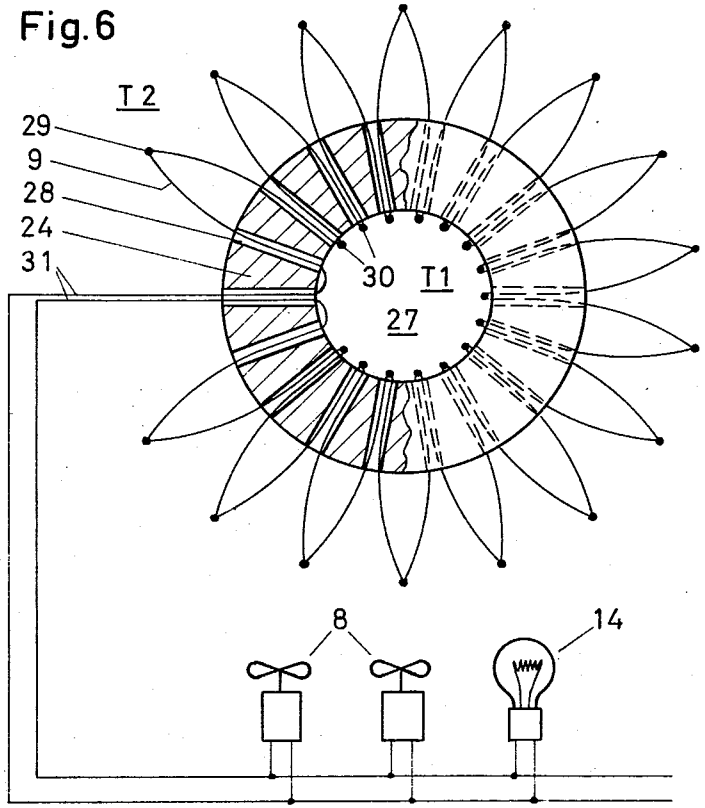
Figure 7:
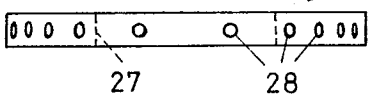
Figure 5:
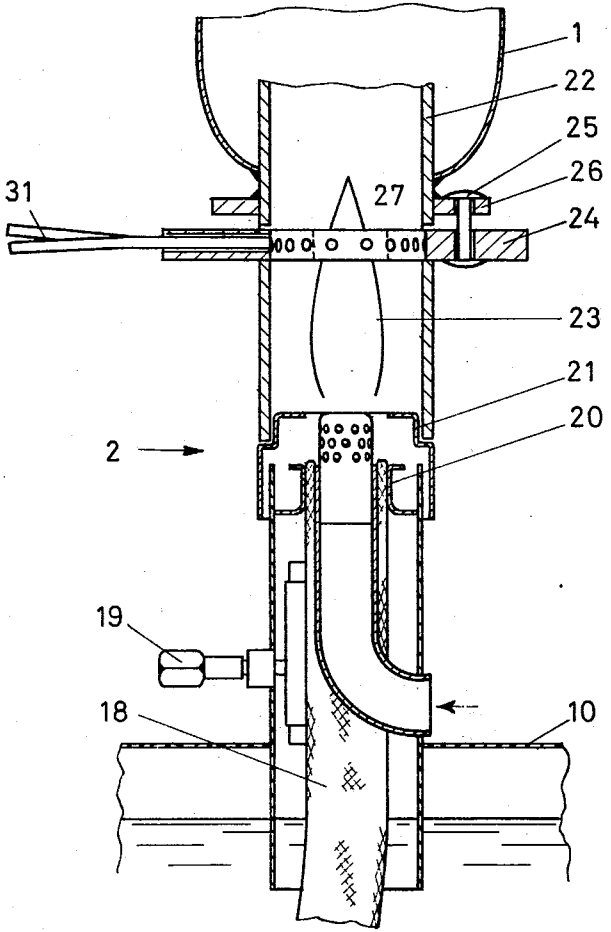

FIG. 4 showing a kerosene burner unit forming part of the invention;

FIG. 6 is a diagrammatic and schematic view of the disposition of thermocouple elements around the heat source, according to the invention; and FIG. 7 is a fragmentary side elevational view of FIG. 5 showing a ceramic plate for the thermocouple elements forming part of the invention.

Figure 2:
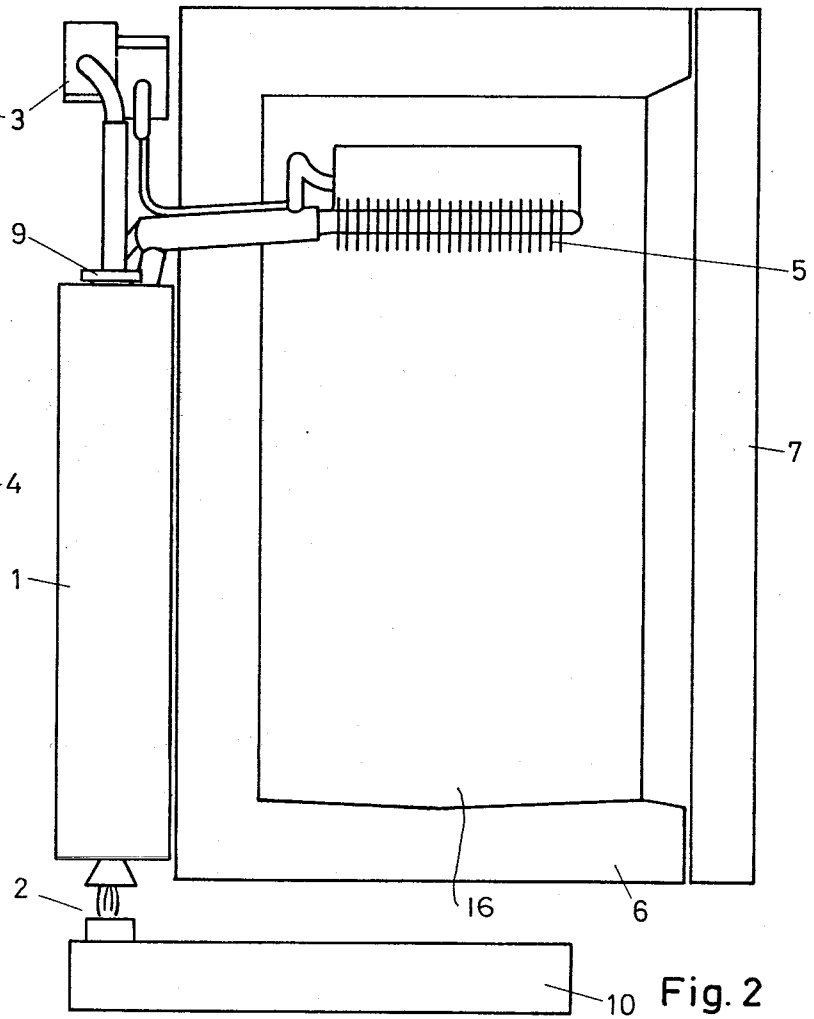
FIG. 2 is a side elevational view, partly in section, of the refrigerator shown in mirror image in FIG. 1.
Figure 1:
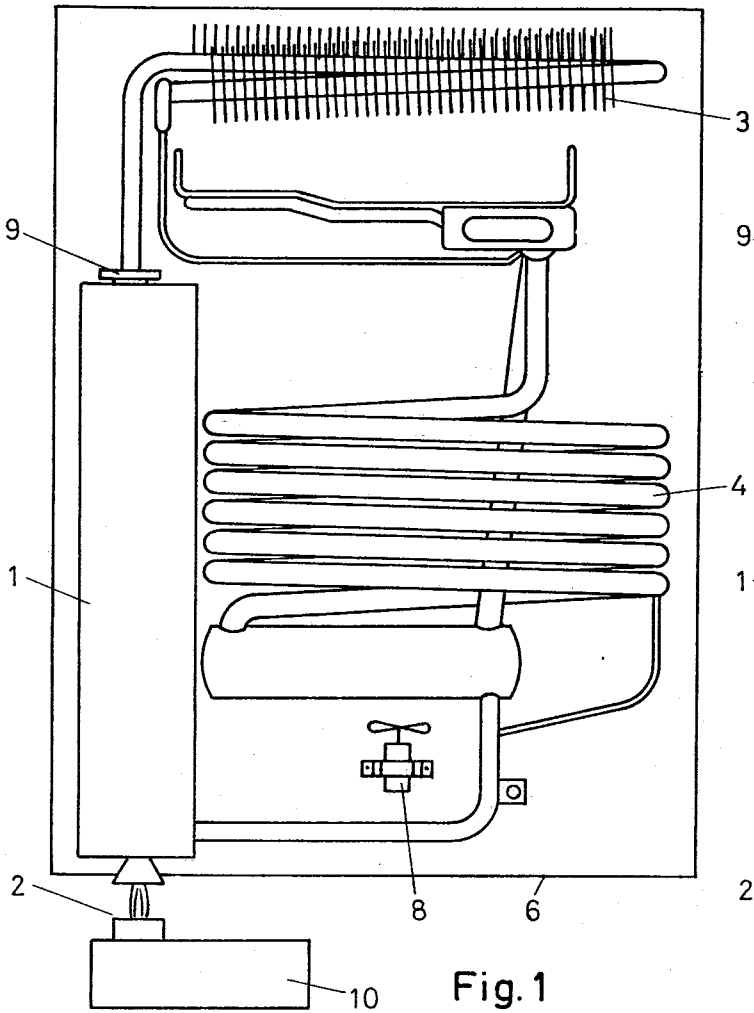
FIG. 1 is an elevational, diagrammatic mirror-image view of the rear, equipment side of a refrigerator with a single temperature zone constructed in accordance with the invention.

Referring now to the drawing, and first particularly to FIGS. 1 and 2 thereof, there is shown an absorption refrigerator according to the invention, which includes an insulated boiler 1 heated by a kerosene burner 2. Also provided are a condenser 3, and absorber 4 and an evaporator 5, the latter being disposed within the refrigerator box or cabinet. The interior 16 of the insulated housing 6 of the refrigerator bos is closable by a door 7. The absorption refrigerator operates with a refrigerant having a high ammonia content in accordance with the conventional continuous Platen Munters System which is well known in the art and is therefore believed to require no further description.

Such refrigerators, which are heated with energy obtained from fossil fuel, are primarily employed when no electric power for heating is available. In order to improve the natural heat convection, particularly at high ambient temperatures, a blower 8 is mounted on the outside of the box or cabinet below the absorber 4. The improved air circulation increases heat removal from the absorber 4 and also from the condenser 3, which consequently effects an improvement in the efficiency of the refrigerator.

The electric power for operating the blower 8 is supplied by thermocouples 9 which are located above the boiler 1 within the effective heating range of the burner 2. A supply tank 10 for kerosene is located beneath the burner 2.

Figure 3:
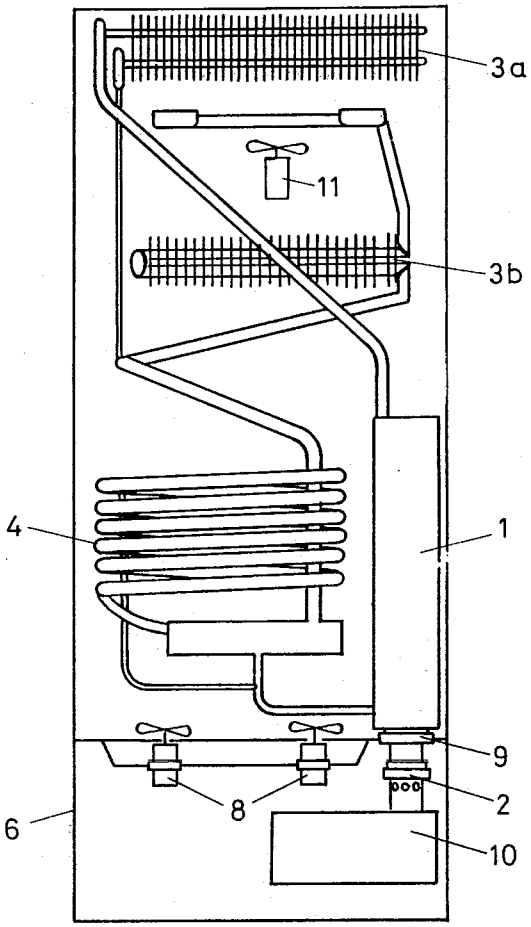
FIG. 3 is a diagrammatic rear elevational view of a refrigerator constructed in accordance with the invention with two temperature zones, the rear cover plate thereof being removed.

Another embodiment of the absorption refrigerator of the invention is shown in FIGS. 3 and 4. It is equipped with two condensers 3*a* and 3*b* and two evaporators 5*a* and 5*b* for two temperature zones. One evaporator 5*a* is located in the low-temperature or freezer compartment 15 and the other evaporator 5*b* in the general cooling or refrigeration compartment 16. Advantageously, this refrigerator of FIGS. 3 and 4 could also be provided with two doors instead of the one door 7, as illustrated.

The thermocouples 9 for generating current are mounted in a ring or crown around the burner 2. To increase air circulation, two blowers 8 are disposed beneath the absorber 4 and another blower 11 beneath the upper condenser 3*a*, outside the box. An equipment cover plate A attached at the rear of the box provides a chimney effect and suitably channels the mechanically moved cooling air. In order to cool the load, that is to be refrigerated, more rapidly, blowers 12 and 13 for air circulation are also mounted in the interior 15, 16 of the refrigerator box. Another electric current-consuming device that is employed is the interior lighting means or lamp 14. Control lamps or pilot lights or, for example, an electrical control device for the heat source in conjunction with a thermostat may also be provided.

The kerosene burner 2 shown in FIG. 5 conventionally includes a wick 18, a regulating device 19 and a wick guide 20 with a flame shield 21. The burner 2 is provided with a chimney 22, which encloses or surrounds the flame 23 and extends into the boiler 1. A ceramic disc 24 formed with a central aperture 27 is disposed above the flame 23 and is fastened by means of screws 25 to a flange 26 of the chimney 22. The ceramic disc 24 is provided as a support for the thermocouples 9 (FIG. 6).

The ceramic disc 24 is formed with radial bores 28, through which the thermocouples 9 are inserted. Each thermocouple 9 has a cold junction 29 located outside the ceramic disc 24 and a hot junction 30 located inside the central aperture 27 thereof. The hot junction 30 heated by the flame 23 may have a temperature T1 of, for example, substantially 1000° C, while the cold junction assumes ambient temperature T2 of, for example 50° C.

Since the thermoelectric voltage of a single thermocouple element 9 is small, a multiplicity of such thermocouple elements 9 is connected in series and the current for the loads 8 and 14 is withdrawn through a common tap 31.

To produce an even higher voltage, several ceramic discs 24 equipped with thermocouples 9 can be disposed one above the other. If necessary, voltage transformers, such as vibrators, for example, can also be provided. Of course, the refrigerator can also be operated with gas or another fuel instead of kerosene.

The absorption refrigerator described above is especially suited for use in tropical countries, in areas where no public electric power is available. By providing thermocouples for electrically energizing blowers or fans, the efficiency of such refrigerators can be increased. Tests have shown that, for constant ambient temperature, the inner temperature of the refrigerator box can be reduced about 5° to 10° C below that of heretofore known refrigerators that do not have mechanical air circulation. On the other hand, an adequate predetermined inner cooling temperature can be attained even for higher ambient temperatures.

In a further non-illustrated embodiment of the absorption refrigerator, the thermocouple is located in the insulation for the boiler 1. Moreover, the electric current supplied by the thermocouple also energizes a heater wire to prevent condensation at the outer housing of the refrigerator cabinet or box. The burner is also equipped with an electrical signaling device, such as a flag, which is responsive if the current should be interrupted. This signaling device serves to prevent an extended shutdown of the refrigerator if the kerosene supply tank should become empty.

I claim:

1. In an absorption refrigerator having a nonelectric boiler heating system, a box having a coolable interior and a side at which refrigerating equipment is mounted, said refrigerating equipment including a boiler and a heating burner located below said boiler for heating the same, electrically energizable blower means carried by said box, at least one centrally apertured ceramic disc formed with radial bores and disposed above said heating burner and substantially concentrically to said heating burner and said boiler so that heat originating in said burner is concentrated in the central aperture of said ceramic disc, and thermocouple means comprising a multiplicity of serially-connected thermocouple elements having respective hot junctions located within the central aperture of said ceramic disc, respective cold junctions located radially beyond the periphery of said ceramic disc and respective means extending through said radial bores for mutually connecting the respective hot and cold junctions to one another, said thermocouple means being electrically connected to said blower means for energizing the latter with electricity generated in said thermocouple means by the heat originating in said heating burner.

2. Absorption refrigerator according to claim 1 wherein said blower means comprises at least one blower located at said equipment side.

3. Absorption refrigerator according to claim 1 wherein said blower means comprises at least one blower located in said coolable interior of said box.

4. Absorption refrigerator according to claim 1 wherein said blower means comprise a plurality of blowers located both in said interior of said box and at said equipment side thereof.

5. Absorption refrigerator according to claim 1 wherein said refrigerating equipment includes an absorber device and at least one condenser device, said blower means being disposed beneath at least one of said devices at said equipment side, and including an equipment cover plate at said equipment side defining with said side a channel for air mechanically movable by said blower means.

6. Absorption refrigerator according to claim 1 wherein said multiplicity of serially connected thermocouple elements has a common tap for electric current connectable to said blower means.

7. Absorption refrigerator according to claim 1 wherein said ceramic disc is disposed between said heating burner and said boiler.

8. Absorption refrigerator according to claim 1 wherein said boiler is provided with a layer of thermal insulation, and said ceramic disc is disposed in said insulation.

9. Absorption refrigerator according to claim 1 wherein said ceramic disc is disposed above said boiler whereby the heat from said heating burner is transmitted through said boiler for heating said hot junctions of said thermocouple elements.

10. Absorption refrigerator according to claim 1 wherein said box has an inner casing and an outer casing, and including a heater wire electrically connected to said thermocouple means and so disposed relative to the outer casing of said box to prevent condensation formation thereat.

11. Absorption refrigerator according to claim 1 including signaling means connected to said heating burner, said signaling means being responsive to an interruption in electrical energy supplied by said thermocouple means.

* * * * *